US007028870B2

(12) United States Patent
Valdez-Campbell

(10) Patent No.: US 7,028,870 B2
(45) Date of Patent: Apr. 18, 2006

(54) FLEXIBLE FOLDABLE MULTI-ARTICLE STORAGE CARRIER

(76) Inventor: Marilyn Valdez-Campbell, 129 S. Madison Ave., Loveland, CO (US) 80537

( * ) Notice: Subject to any disclaimer, the term of this patent is extended or adjusted under 35 U.S.C. 154(b) by 709 days.

(21) Appl. No.: 09/992,641

(22) Filed: Nov. 13, 2001

(65) Prior Publication Data

US 2003/0089749 A1 May 15, 2003

(51) Int. Cl.
*A45F 4/02* (2006.01)

(52) U.S. Cl. ..... 224/153; 224/584; 224/586; 224/653; 224/684; 383/4

(58) Field of Classification Search ..... 224/575, 224/576, 153, 156, 584, 586, 627, 653, 684; 383/4

See application file for complete search history.

(56) References Cited

U.S. PATENT DOCUMENTS

| | | | | | |
|---|---|---|---|---|---|
| 36,710 | A | * | 10/1862 | Hamlin | 383/39 |
| 621,824 | A | | 3/1899 | Kleeman et al. | |
| 1,679,101 | A | * | 7/1928 | Sternthal | 206/553 |
| 2,679,877 | A | * | 6/1954 | Leggrtt | 383/39 |
| 3,976,113 | A | | 8/1976 | Kim | |
| 4,188,988 | A | | 2/1980 | Agyagos | |
| 4,197,891 | A | | 4/1980 | Comollo | |
| D269,923 | S | | 8/1983 | Carrier et al. | |
| D275,812 | S | | 10/1984 | Deacom | |
| 4,489,815 | A | | 12/1984 | Martinez et al. | |
| D278,572 | S | | 4/1985 | Gargioni | |
| 4,516,668 | A | | 5/1985 | Grayek | |
| 4,535,878 | A | | 8/1985 | Grahl | |
| 4,551,127 | A | | 11/1985 | Rich et al. | |
| 4,587,682 | A | * | 5/1986 | Schultz | 5/413 R |
| D289,228 | S | | 4/1987 | Chinman | |
| D292,646 | S | | 11/1987 | Pitini, II et al. | |
| D295,116 | S | | 4/1988 | Mensing | |
| D297,283 | S | * | 8/1988 | Gray | D3/299 |
| 4,825,985 | A | | 5/1989 | Kim | |
| 4,863,003 | A | | 9/1989 | Carter | |
| 4,874,340 | A | | 10/1989 | Smallwood | |
| 4,881,684 | A | | 11/1989 | Chinman | |
| 4,901,464 | A | * | 2/1990 | Banoun | 42/95 |
| D307,825 | S | | 5/1990 | Makraner et al. | |
| D307,826 | S | | 5/1990 | Makraner | |
| 4,960,204 | A | | 10/1990 | Young et al. | |
| 4,967,986 | A | | 11/1990 | Schildkraut | |
| 4,984,906 | A | | 1/1991 | Little | |
| 4,991,245 | A | | 2/1991 | Franco | |
| 5,002,401 | A | * | 3/1991 | Blackman | 383/38 |
| 5,103,515 | A | | 4/1992 | Bird | |
| 5,139,143 | A | * | 8/1992 | Pond | 206/373 |
| 5,332,093 | A | | 7/1994 | Littlepage | |
| 5,443,880 | A | | 8/1995 | Wike | |

(Continued)

FOREIGN PATENT DOCUMENTS

WO WO 98/52439 * 11/1998

*Primary Examiner*—Stephen K. Cronin
(74) *Attorney, Agent, or Firm*—James K. Poole, Esq.

(57) ABSTRACT

A multi-article storage carrier is based upon a sheet of flexible material comprising a plurality of compartments on one side for containing the articles, the sheet being folded at least once in each direction to form the carrier and enclose the articles securely. Securing and carrying means such as straps are provided on the surface of the sheet opposite the compartments so that they are exposed for use when the carrier is folded and/or rolled for carrying.

19 Claims, 18 Drawing Sheets

U.S. PATENT DOCUMENTS 5,540,609 A 7/1996 Hoag
5,618,110 A * 4/1997 Sullivan ..... 383/4
5,622,300 A * 4/1997 Robinson ..... 224/575
5,653,337 A * 8/1997 Cirigliano ..... 206/373
5,730,529 A * 3/1998 Fritz et al. ..... 383/4
5,797,529 A 8/1998 Lavine
5,887,301 A 3/1999 Anderson
6,053,634 A 4/2000 Kay
6,135,635 A * 10/2000 Miller et al. ..... 383/2
6,230,950 B1 * 5/2001 Heetman ..... 224/575

* cited by examiner

FLEXIBLE FOLDABLE MULTI-ARTICLE STORAGE CARRIER

BACKGROUND OF THE INVENTION

1. Field of the Invention

The present invention pertains to storage and carrying devices for multi-article collections, particularly for toys, dolls and their accessories.

2. Description of Relevant Art

Young children play with a variety of toys, such as miniature cars, small dolls, and action figures. Play with many of these toys involves the use of a multitude of accessories, such as garments, footwear, recreational equipment, purses, packs and the like. Problems arise in how children store these separate items when not in use and in how they carry them from place to place. Presently, boxes or rigid carrying cases are often used for storing and/or carrying such toys and their accessories. Problems exist, however, with the prior art designs in that they are bulky, heavy and/or easily damaged. For example, the carrying cases produced by Mattel Corp. for the well-known "Barbie Doll" line are generally constructed of rigid plastics which gradually deteriorate with exposure to the atmosphere, and are assembled with weak fastener devices which allow the cases to be easily damaged. Such carrying cases are offered for single dolls and accessories, and larger models for multiple dolls resembling a suitcase.

A number of patents have been issued for carrying and storage devices for small items. For example, U.S. Pat. No. 4,960,204 discloses a softside travel bag for cosmetics having a plurality of separate individual inside compartments and which is foldable for carrying (by carrying straps) and storage and is hangable in an open vertical position in which personal care items may be removably stored.

U.S. Pat. No. 5,002,401 discloses an article holder and carrier including a box-like container having fabric walls reinforced with soft, shock-absorbing material and adapted to disconnect along an edge between two walls and around three edges of a base panel to unfold to a flat position for access to articles held within the holder/carrier. The unit includes pockets or compartments sewn to an inner surface of the fabric walls and base panel with the pockets being adapted to hold the articles against the fabric walls to provide support therefor.

U.S. Pat. No. 4,489,815 discloses a combination picnic bag and mat which provides both a carrying bag or box and a semi-rigid surface which can be used for carrying or holding food and for providing a table-like surface. The flat panels of the unit can be folded stepwise into a box-like shape, suitable for maintaining a semi-rigid internal space. The folded unit is held together at strategic points with fasteners and is provided with straps for carrying and reinforcement.

U.S. Pat. No. 4,874,340 discloses a combined children's amusement device and transport/storage pack which folds like a book, the outer surface having at least one stuffed toy or the like mounted thereon and the inner surfaces containing storage pockets and a centrally-mounted children's storybook.

U.S. Pat. No. 4,984,906 discloses a multi-purpose utility tote based upon a flat, T-shaped sheet having a zipper chain mounted about the perimeter. When completely open, the unit can provide a flat, cushioned surface. By zipping the unit together, starting the slide fastener at an internal corner of the flat, T-shaped unit, the unit can be transformed into a parallelepiped-shaped container.

U.S. Pat. No. 4,881,684 and U.S. Design Pat. No. 289,228 disclose a wrapper for articles such as clothing. The wrapper is foldable into a sort of envelope which is useful as an adjustable briefcase, and securing members and straps are provided. FIG. 13 shows the unit with straps arranged to serve as a backpack.

U.S. Pat. No. 4,535,878 discloses a pillow-tote bag containing pockets. The unit can be folded to retain items in the pockets for carrying and serves as a pillow or head rest when open.

U.S. Pat. No. 4,188,988 discloses a sheet assembly for use as a multipurpose tote bag. The sheet is folded multiple times and interior-mounted zippers are used to fasten the outer edges of the resulting bag, with carrying handles protruding from the top.

U.S. Pat. No. 4,197,891 discloses a combination beach mat and shoulder bag based upon a rectangular sheet of flexible material which can be folded into a bag for carrying beach clothes.

U.S. Pat. No. 4,967,986 discloses a carryall for transporting articles including a towel to a bathing area, including an elongate and flexible pouch formed into a plurality of closable compartments in the interior. Fasteners are formed on an inner surface of one end portion of the pouch and the outer surface of the opposite end portion so that the pouch can be formed into a circular enclosure and held by the fasteners to define an area enclosing a rolled beach towel.

U.S. Pat. No. 4,516,668 discloses a combination knock-down handbag and mat which is formed of a sheet of material of predetermined length and width which is so seamed and secured that in the assembled or folded position it forms a handbag and in the unfolded position it can be used as a beach mat.

U.S. Pat. No. 3,976,113 discloses a convertible blanket adapted to form a tote bag with an open top and carrying straps, based upon a flat sheet of fabric having four zippers positioned to fasten the four corners of the tote bag.

U.S. Pat. No. 4,991,245 discloses a portable lounge mat/pillow set based upon a flexible sheet, which is convertible to and from a closed tote bag for carrying articles by folding portions of the sheet over and upon one another, forming interior article-holding compartments in the process.

U.S. Pat. No. 4,825,985 discloses a conventional foldable garment carrier with a central chamber for garments closed by a cover with a zipper. Pockets are provided on the sides of the unit.

U.S. Pat. No. 621,824 discloses a satchel based upon a flexible sheet of material which can be folded to form a carrier which is triangular in cross section or rolled up for compact storage.

U.S. Pat. No. 4,863,003 discloses a combination seat cushion and tote bag comprising a seating portion and at least one side portion having a pocket enclosure secured to its upper surface, including means for releasably securing the side portion in an overlapping position with the seating portion.

U.S. Pat. No. 5,540,609 discloses a "story quilt" and an associated set of dolls, the dolls to be secured to specific panels of the quilt, which can be secured to a wall for storage and display.

U.S. Pat. No. 5,332,093 discloses a "mailbox shaped doll and accessory carrier" based upon a blanket containing pockets for dolls and accessories and rigid inserts about which the blanket can be folded to form a mailbox-shaped carrier.

A number of design patents also disclose carrying devices having pockets. U.S. Des. Pat. No. 275,812 discloses a multipocket apron for carrying children.

U.S. Des. Pat. No. 269,923 discloses a drawing carrying case which folds and rolls for carrying articles therein.

U.S. Des. Pat. No. 295,116 discloses a travel tote for dolls comprising two flat portions which fold like a book to enclose dolls therein.

U.S. Des. Pat. No. 292,646 discloses a multiple pouch tote bag having a number of open pouches on the sides, all of which can be enclosed by a cover.

U.S. Des. Pat. Nos. 307,825 and 307,826 disclose folding tote bags.

U.S. Des. Pat. No. 278,572 discloses a tote bag shaped somewhat like a bent cylinder or banana, with carrying handle attached.

Despite more than a century of patented designs for various types of combination carrying devices, there remains a need for a flexible unit fitted with pockets for holding a plurality of objects such as a set of dolls and accessories, which can be folded and/or rolled by a child to form a compact assembly which securely encloses the objects for carrying or storage.

SUMMARY OF THE INVENTION

The solution the present invention offers to the aforementioned problems is to provide a flexible foldable multi-article storage carrier assembly which is compactable, lightweight and not easily damaged. Such capabilities will solve most or all of the problems with prior art designs.

It is thus an object of the present invention to provide a flexible unit which can serve as a mat or blanket when unfolded and a carrier when folded or rolled. Another object of the invention is to provide pockets or compartments for storage or carrying a plurality of articles such as dolls and accessories. A further object of the invention is to provide a carrier which securely encloses the compartments which contain such articles, when folded for carrying or storage. Yet another object is to provide the carrier with handles or carrying straps which protrude from the unit when folded for carrying and can be used for hand carrying or for strapping the unit to the owner's back like a backpack.

To fulfill these objects, in accordance with the present invention, a multi-article storage carrier is provided which comprises a sheet of flexible material having on one surface a plurality of compartments for enclosing the articles and on the other surface securing and carrying means which are so arranged as to compactly secure the carrier and to provide carrying means such as handles or straps when the sheet is folded and/or rolled at least once each in its longitudinal and lateral dimensions to enclose the compartments and the articles therein in the interior of the folded carrier. Preferably, the compartments of the carrier are arranged with their open sides oriented to face in the same direction. The carrier can be provided with attachment means along one side for hanging the carrier up, with the openings of the compartments facing upward. At least some of the compartments can be provided with closure means such as flaps of flexible material and/or mechanical fasteners.

In a preferred embodiment, a plurality of compartments are arranged along two opposing edges of the sheet and are sized and configured to contain accessories, and at least one plurality of compartments are located in the central portion of the sheet, being sized and configured to contain dolls or action figures.

The carrying means on the opposite side of the sheet can be straps configured and positioned to serve as handles and/or shoulder or backpack straps, and can be adjustable to facilitate such use. The securing means can include at least one strap which can be passed completely about the folded carrier and interconnected, or used to fasten the carrying straps together. Various securing means can be provided which are parallel and/or perpendicular to the carrying straps.

The flexible sheet comprises at least one layer of a fabric, selected from woven and nonwoven fabrics of natural and synthetic fibers, and can include cushioning material. When suitable fabrics and/or cushioning materials are used, the flexible sheet can be used as a blanket or mat when the compartments are emptied. Various colors and ornamental and/or informational designs can be applied to either or both sides of the sheet to enhance its appearance when open and/or folded for carrying or storage. Such colors and designs, as well as attached labels, tags and the like, can be used to identify the source of the goods, the items to be contained within the device, and various types of advertising materials.

Additional objects and advantages of the present invention are described in, and will be apparent from, the following detailed description of preferred embodiments together with the drawings and appended claims.

DETAILED DESCRIPTION OF PREFERRED EMBODIMENTS

It should be understood that the following description of the presently preferred embodiments of the present invention is merely representative of many possible embodiments and thus is not intended to limit the scope of the present invention. In the following description, like structures in the various figures will be referred to by similar numerical designations. In some figures, some features may be omitted or exaggerated in scale to clarify the illustration of all features. The term "and/or" will be used in the conventional sense, in which "A and/or B" signifies A or B alone or A and B together.

Figure 1:
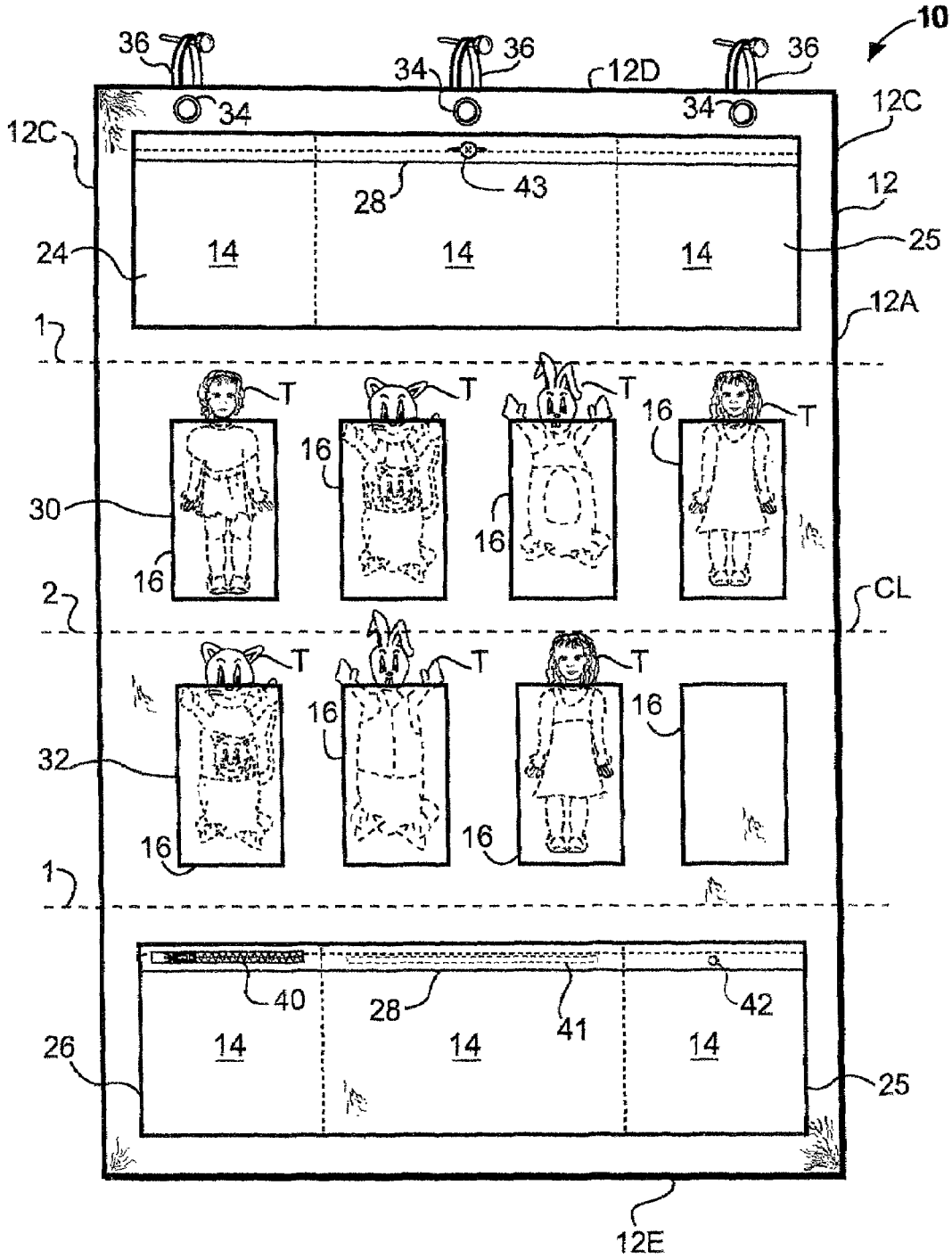
FIG. 1 is a plan view of a carrier of the present invention showing a plurality of pockets.
Figure 2:
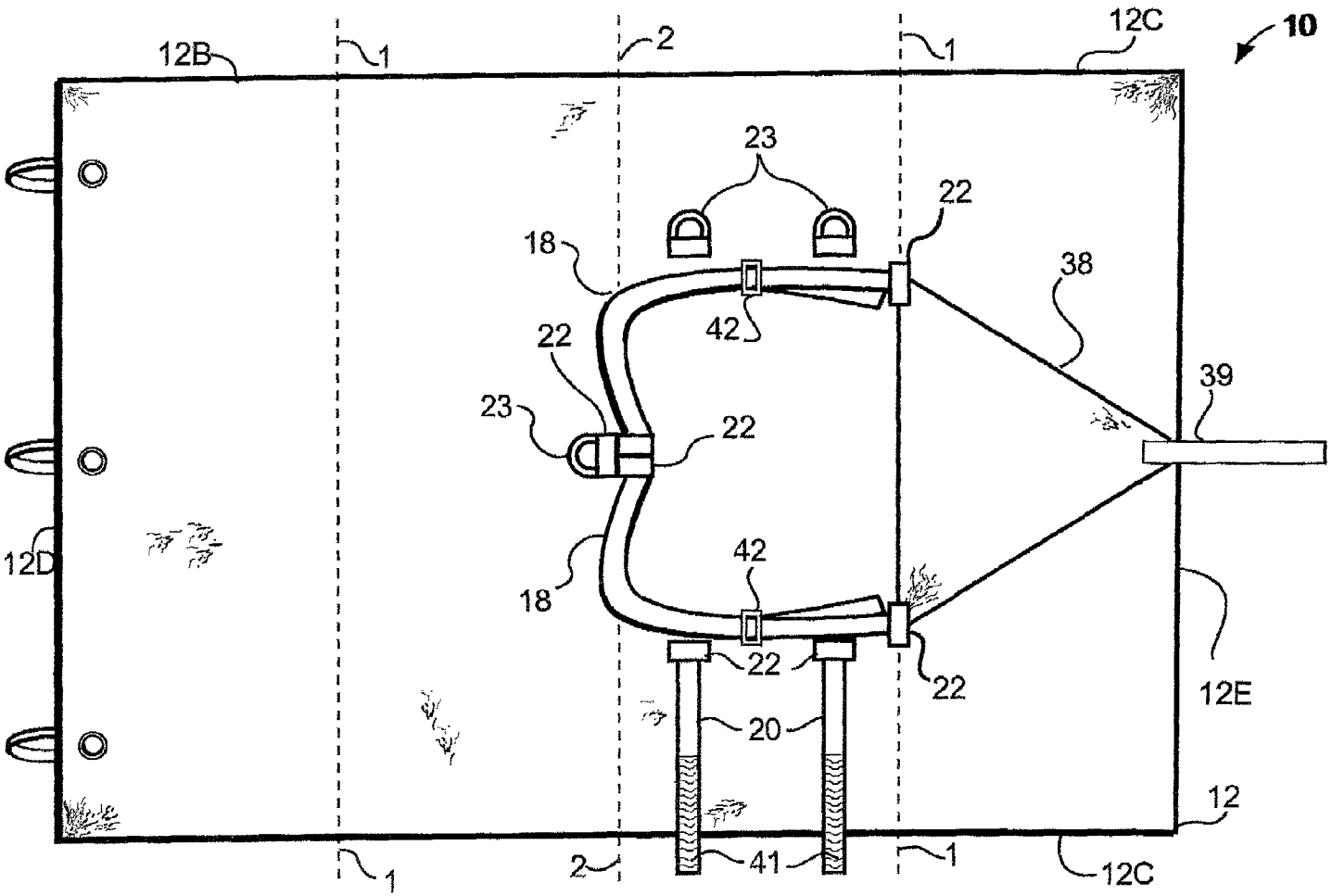
FIG. 2 is a plan view of the opposite side of the carrier of FIG. 1 showing securing and carrying means.

Referring now to the drawings, FIGS. 1 and 2 illustrate a flexible foldable multi-article storage carrier assembly, generally designated 10, of the present invention. The flexible foldable multi-article storage carrier assembly 10 basically includes a blanket 12 having on one surface 12A a plurality of spaced apart first compartments 14, along each transverse edge, and a plurality of spaced apart second compartments 16, arranged in two rows down the center of blanket 12. The opposite surface has a pair of spaced apart flexible straps 18 for carrying the carrier, and/or multiple flexible retention straps 20 and a means 22 of attaching them to blanket 12, plus buckles or similar connectors 23 for securing the rolled carrier, all attached to the opposite side 12B of the blanket 12 from the compartments. The carrying and securing straps can be attached in a variety of positions to secure the folded/rolled assembly for storage, carrying or use as a back pack. Straps 20 can be attached to blanket 12 at points 22 by permanent means such as sewing, rivets or gluing, and optionally can be removably attached in these and other locations by conventional means such as snap fasteners, buckles, hook-and-loop material combinations and the like (not shown here).

Although the present embodiment is based upon a "blanket" of rectangular shape, this component can be a flexible sheet of any suitable material, cut to any suitable shape and size. As shown in FIG. 2 and subsequent figures, an optional securing piece 38 is mechanically attached to blanket 12 adjacent the ends of straps 18. Securing piece 38 can be made of fabric or any other suitable materials, and can be triangular as shown or any suitable shape, such as oval or half-round. Securing piece 38 is fastened to blanket 12 only along one edge adjacent the ends of straps 18, and extends to the edge of blanket 12, substantially parallel to straps 18. A securing strap 39 is mechanically attached at the opposite end of securing piece 38. Buckle 23 or other suitable fastener is provided at the opposite end of straps 18 (shown here as connected to blanket 12 at the same point via means 22), and can be used with securing strap 39 to secure the folded, rolled carrier 10, as discussed and illustrated below.

The blanket 12 preferably has a rectangular configuration and has opposite front and rear surfaces 12A, 12B, opposite side (longitudinal) edges 12C and top and bottom (transverse) edges 12D, 12E. (Top and bottom are determined by which side is to be uppermost when the blanket is hung up, as explained below.) The greatest dimension is the blanket's length, or longitudinal dimension, and the lesser dimension is the width or transverse dimension.

The blanket 12 is made of any suitable flexible material, such as a cloth or plastic fabric, for example any suitable commercially available conventional bed covering, such as a quilt or comforter. Woven or non-woven fabrics of natural or synthetic fibers, or mixtures thereof, can be used. Preferably the fabric incorporates some cushioning effect, as with conventional blanket materials, felts, quilted materials and the like, to provide any needed protection for the articles placed in the compartments and to allow the blanket to serve as a blanket for children's naps, etc., when all compartments are emptied of the articles. The fabric and all components of the assembly are preferably easily washable. The blanket can be assembled of multiple layers in addition to the layers used to attach the compartments; for instance, two surface layers of material could be used to enclose a layer of batting or other cushioning material, and an outer layer could be waterproof or water-resistant. The blanket 12 may also have any other suitable configuration. A carrier designed for outdoor activities such as hunting, fishing or camping could employ blankets of lightweight reflective/insulating material commonly sold as "survival blankets".

Figure 3:
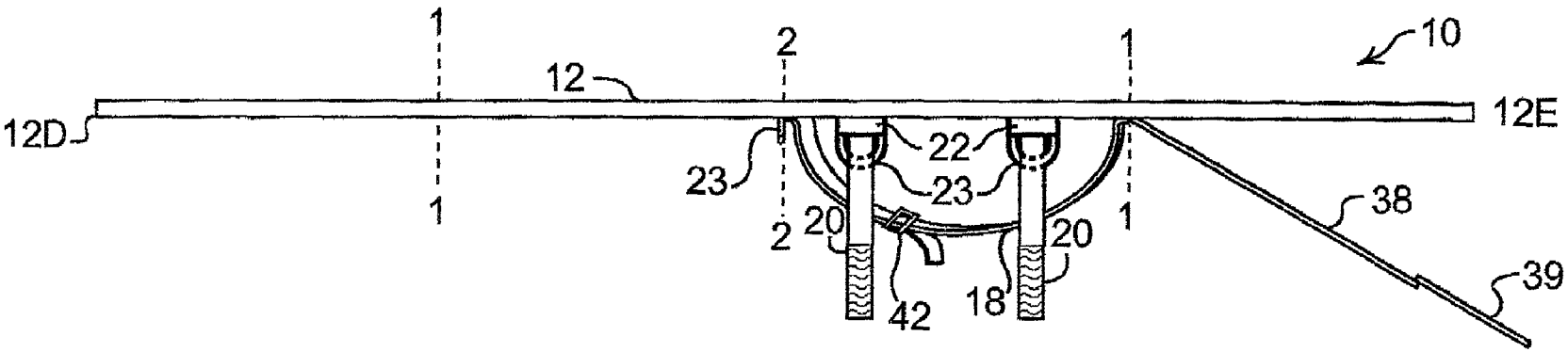
FIG. 3 is a side view of the carrier, with the pocket side placed upward.
Figure 3A:
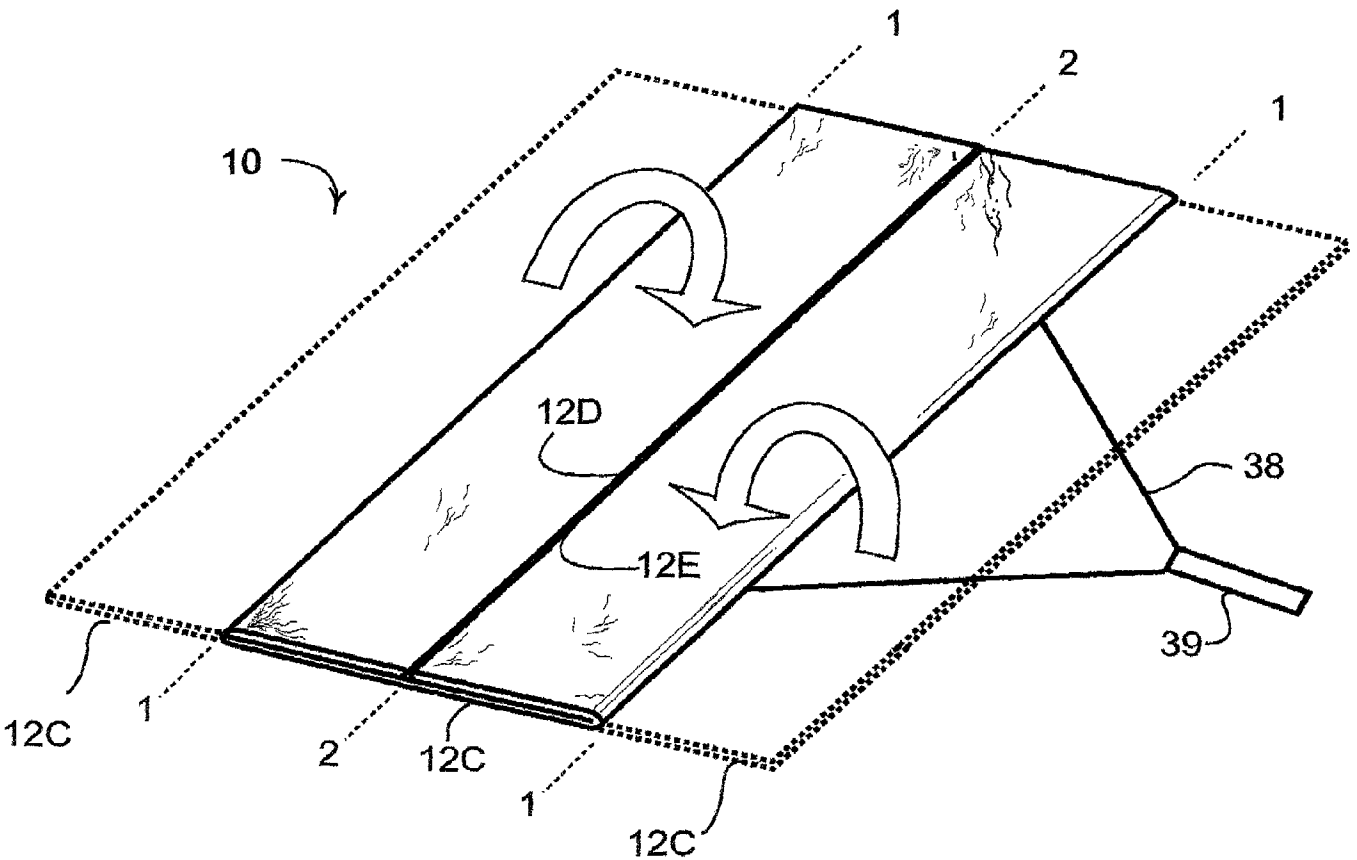
FIG. 3A is a top perspective view of the carrier showing the first two folds for compacting the carrier.
Figure 3B:
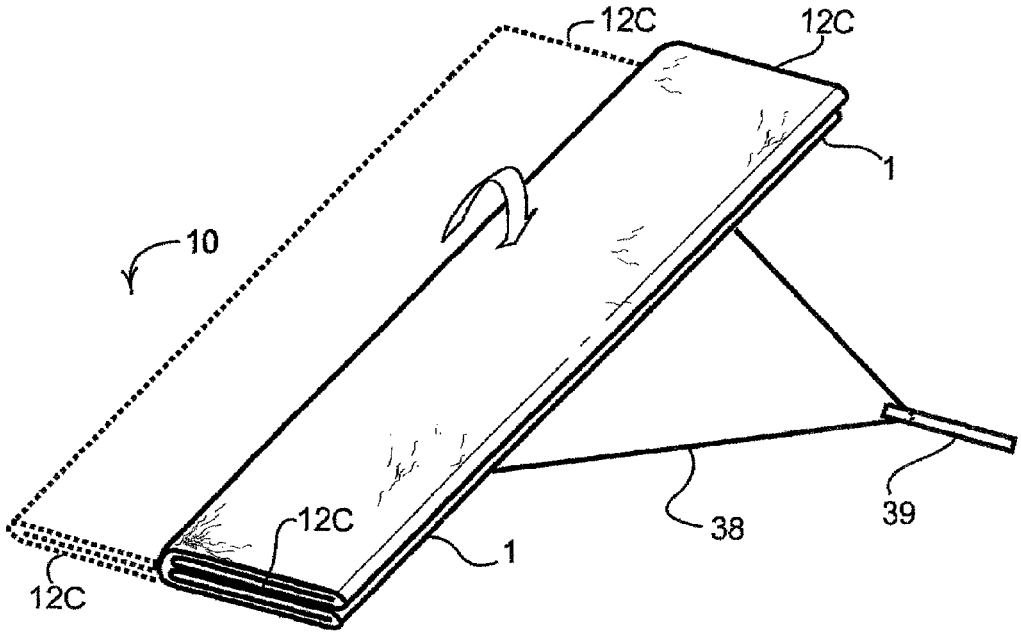
FIG. 3B is a top perspective view of the carrier showing the third fold.
Figure 3C:
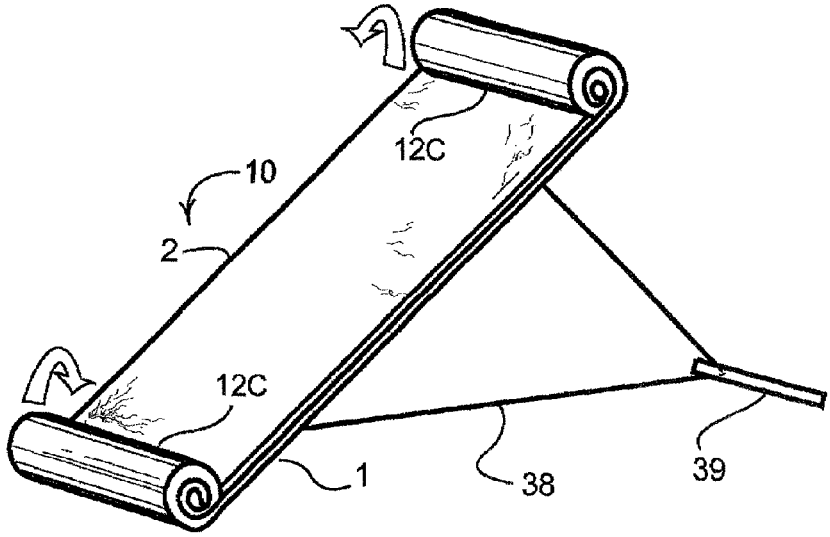
FIG. 3C is a top perspective view showing the ends being rolled toward the middle of the carrier.
Figure 4:
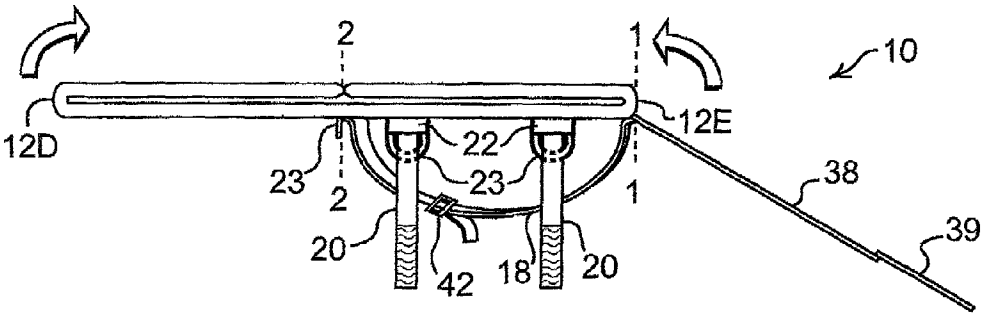
FIG. 4 is a side view corresponding to FIG. 3A showing the first two folds.
Figure 5:
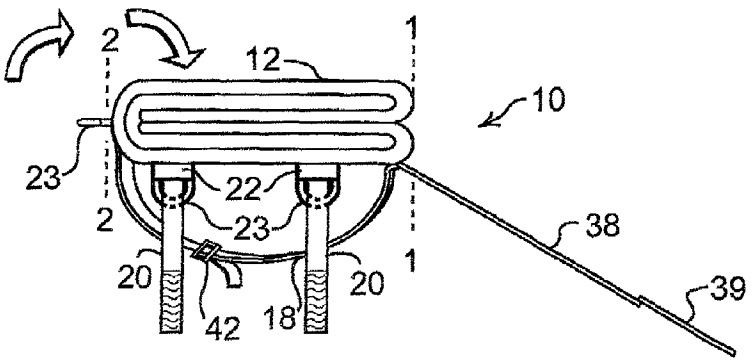
FIG. 5 is a side view corresponding to FIG. 3B showing the third fold.
Figure 6:
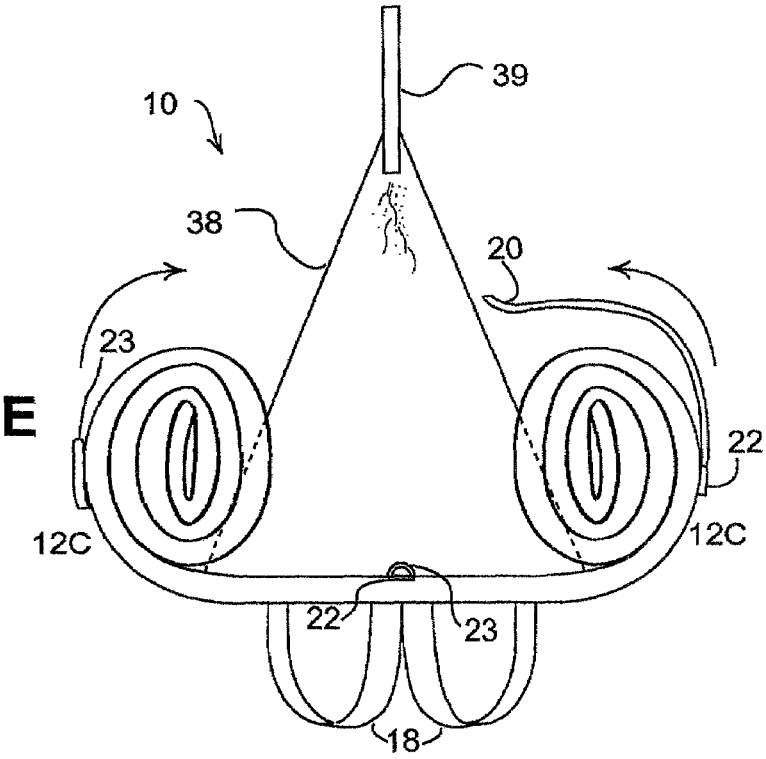
FIG. 6 is a side view corresponding to FIG. 3C showing the rolling process of the ends toward the center.
Figure 7:
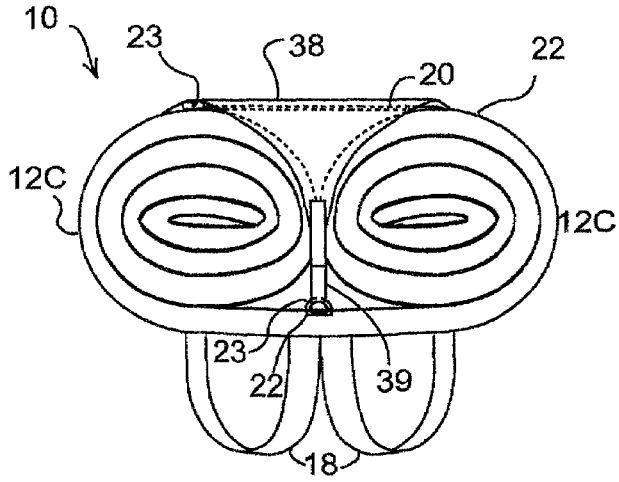
FIG. 7 is an end view showing the carrier in its final folded/rolled configuration with all the straps in place and the support material in place.
Figure 8:
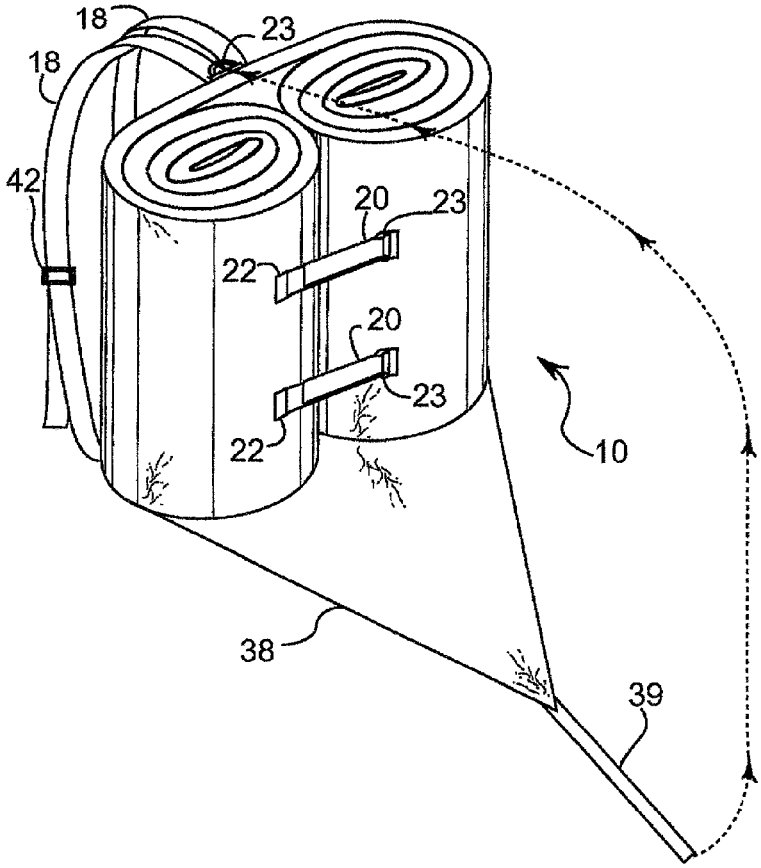
FIG. 8 is a side, upright view showing the support material folding into place and attachment to the top loop.

The blanket 12 is further convertible between an unfolded/unrolled condition, as seen in FIGS. 1 and 2, and a folded/rolled condition for carrying or storage, as seen in FIGS. 7, 8, 11 and 12. In converting the blanket 12 to the folded/rolled condition, as illustrated in FIGS. 3 to 8, blanket 12 is first folded lengthwise by first being folded in half (upper end 12D along axis 1 to axis 2 and lower end 12E along axis 1 to axis 2, as seen in FIGS. 3A and 4) along a pair of outer parallel fold lines (1) extending generally parallel to the top and bottom edges 12D, 12E of the blanket 12, and then folded again in half (upper edge 1 to lower edge 1 along axis 2, as in FIG. 3B). The lengthwise folded blanket 12 (represented in FIGS. 5 and 3C) is then rolled widthwise from each end, (as seen in FIGS. 3C and 6). Finally, each end of the folded blanket is rolled inward until they meet in the center of the carrier, as shown in FIG. 7. This leaves the flexible straps 18 exposed and parallel to the longitudinal dimension of the rolled blanket. All compartments and their contents are enclosed and secured. The blanket is then secured in the rolled condition with strap assemblies 20 by passing strap assemblies 20 to or through connector 23 to hold each rolled portion together, as seen in FIG. 7. Hook-and-loop material 41 on straps 20, as shown in FIG. 2, can be used to secure the straps.

After the blanket 12 is rolled and strapped by straps 20 and connector/buckles 23, the optional securing fabric piece 38 is folded up over the rolled assembly 10 and secured by strap 39 through or to a separate connector 23, (using the same or similar securing materials and techniques as detailed below for other strap and connector/buckle assemblies) attached at the point (on axis 2) where the upper shoulder straps 18 are attached to side 12B of the blanket 12. (See FIGS. 2 and 8.) This securing fabric piece provides support for the rolled segments of the blanket 12 and offers space for advertising, logos, name brands, user identification, etc. The securing fabric piece 38 and securing strap 39 are optional to the overall design of the carrier 12, but provide improved means of securing the folded/rolled unit.

Figure 9:
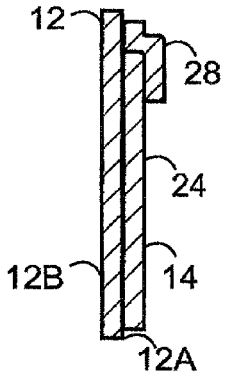
FIG. 9 is a partial sectional view of the carrier illustrating closures for the compartments.

The plurality of spaced apart first compartments 14, as seen in FIGS. 1 and 9, are attached on the front side 12A of the blanket 12 and form upper and lower rows 24, 26 which are disposed, respectively, adjacent to the top and bottom edges 12D, 12E and extend between the opposite side edges 12C of the blanket 12. The first compartments 14 can be formed either by individual pieces of material attached to the blanket 12 or, more preferably, by an elongated piece of material 25, as shown in FIG. 1, which is then attached or sewn to the blanket 12 so as to form the first compartments 14. The material forming the compartments can be similar to the blanket material described above, or alternatively can be a fabric or plastic mesh which allows the contents to be visible. The first compartments 14 are sewn closed along their bottoms (facing the blankets' center and adjacent edge 12E) and the opposite sides of both rows are left open at their top edges (i.e., facing in the same direction as the open ends of the compartments 14). As seen in FIGS. 1 and 9, additional strips of material 28 may be attached to the blanket 12 along the open edges and overlapped with the top edges of the first compartments 14 so as to overlie and cover the open top edges, thus keeping the contents secure. Additionally and alternatively, any or all of the compartments can be provided with mechanical closure means such as zippers 40, snap fasteners 42, buttons 43, hook-and-loop material combinations 41 and the like, as shown in FIGS. 1 and 2.

Figure 10:
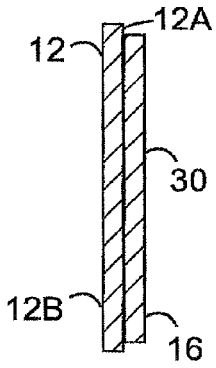
FIG. 10 is a partial sectional view of the carrier illustrating compartments without closures.

The first compartments 14 can be used to store accessories for the toys T stored in the second (central) compartments 16. For dolls and action figures, such accessories could include garments, shoes, recreational equipment, helmets, weapons, purses, combat packs and the like. The plurality of spaced apart second compartments 16, as seen in FIGS. 1 and 10, are attached on the front side 12A of the blanket 12 and form upper and lower inner rows 30, 32 which are disposed adjacent to one another and, respectively, adjacent to the upper and lower outer rows 24, 26 of compartments 14 and extend between the opposite side edges 12C of the blanket 12. Alternatively, a single row of larger compartments can be located in the center of the blanket. Like the first compartments 14, the second compartments 16 can be formed either by individual pieces of suitable material attached to the blanket 12 or, more preferably, by an elongated piece, 30 or 32 as shown in FIGS. 1 and 10, which is then attached or sewn to the blanket 12 so as to form the second compartments 16. The second compartments 16 are sewn closed along their bottoms and to the opposite sides and left open at their top edges (i.e., facing in the same direction as the open ends of the compartments 14). The second compartments 16 can be used to store toys T, such as miniature cars, small dolls and action figures. The resulting central location provides the maximum protection for the toys.

The pair of spaced apart flexible straps 18, as seen in FIGS. 2, 3, 4, 5, 6, 7 & 8, are attached on the rear side 12B of the blanket 12 and spaced inwardly from the opposite side edges 12C and top and bottom edges 12D, 12E of the blanket 12 so as to provide a pair of handles for gripping or shoulder straps for wearing by a user to carry the carrier assembly 10 when in final folded/rolled condition. The flexible straps 18 can be made of any suitable substantially flexible material such as fabric, leather or plastic materials, but preferably are easily washable. Straps 18 can be adjustable in length, as shown in FIG. 2 at 42, and can thus be easily adjusted to permit the use of the rolled assembly as a backpack.

The flexible retention strap assembly 20, 22 and connector/buckle 23, as seen in FIG. 2, are attached to the rear side 12B of the blanket 12 adjacent to the flexible straps 18 which, when the blanket 12 is in the final folded/rolled condition, are attached together, as represented in FIG. 7, to retain the blanket 12 in the final folded/rolled condition. In the rolled condition, the sets of first and second compartments 14 and 16 are inside the folded blanket 12 so that their contents are prevented from falling out. The flexible retention strap assemblies 20, 22 can be made of any suitable substantially flexible material, as described above for the straps 18. The connector/buckle 23 is of any conventional type, and is made of any suitable substantially rigid material such as plastic, metal or wood. As an alternative to connectors/buckles or similar mechanical fasteners, fastening means 41 (See FIG. 2.) based upon hook-and-loop material such as Velcro™ can be provided for straps 20.

A plurality of spaced apart holes 34 can be defined in the blanket 12 along the upper edge 12D thereof and/or a plurality of spaced apart hanger loops 36 can be attached to the upper edge 12D of the blanket 12. The holes 34 or loops 36 can be used to hang the blanket 12 in the unfolded condition of FIG. 1 on a wall or like vertical surface. The articles in the compartments are then easily accessible and visible while not taking up space on the floor or furniture.

Figure 11:
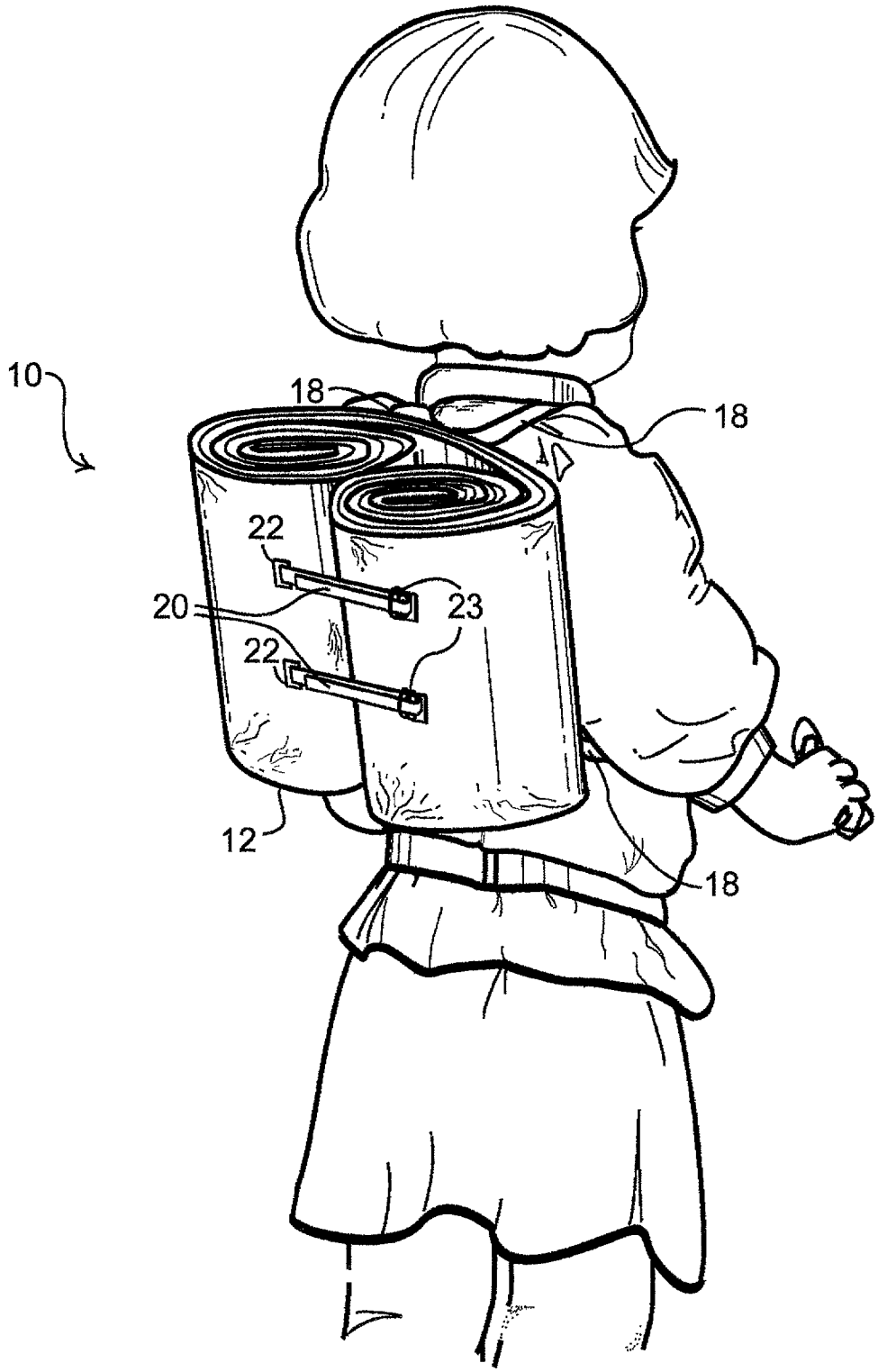
FIGS. 11 and 12 are perspective views of a user with the folded/rolled carrier in place as a backpack, FIG. 12 featuring an optional triangular securing piece with attached strap.
Figure 12:
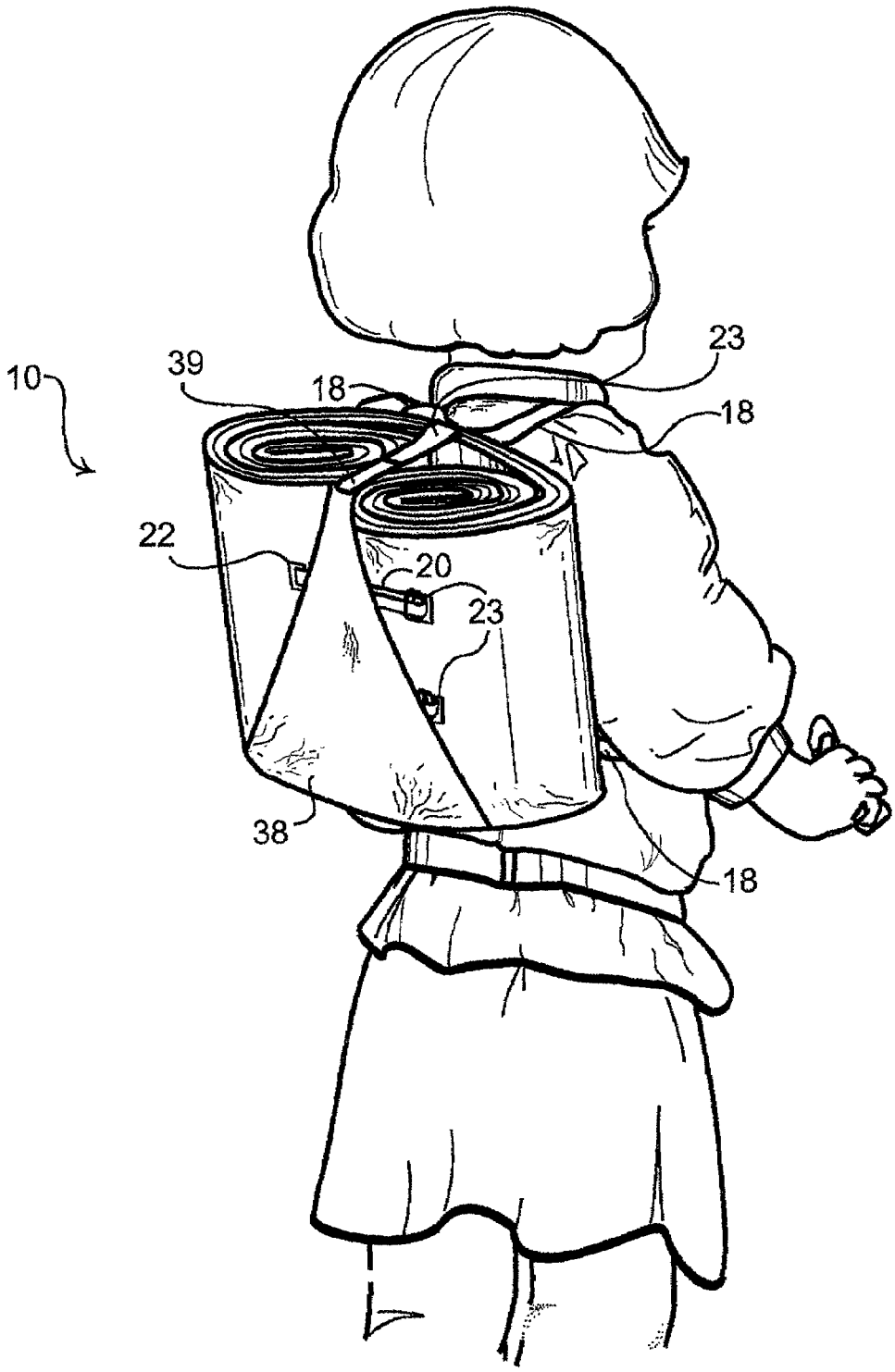
Figure 12A:
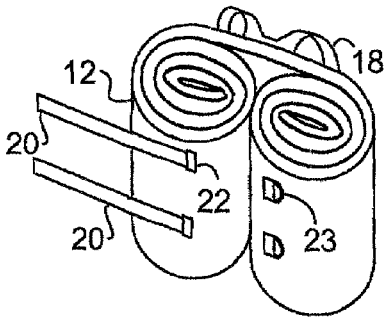
FIGS. 12A through 12H are perspective views illustrating various modes of folding, rolling and securing the carrier of FIGS. 1 through 12.
Figure 12E:
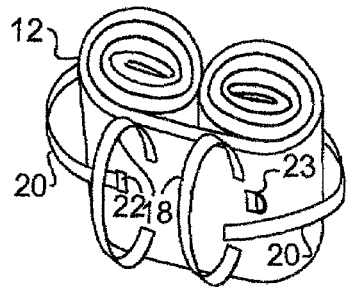
Figure 12B:
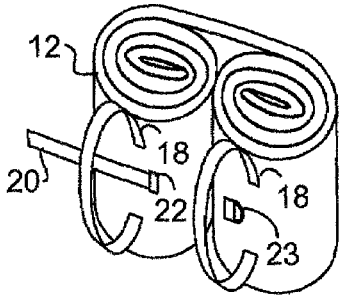
Figure 12F:
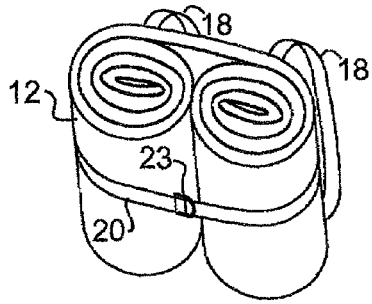
Figure 12C:
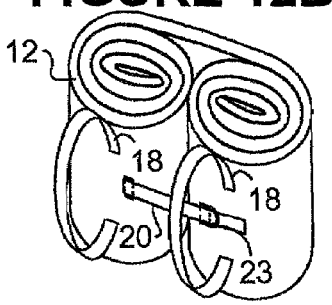
Figure 12G:
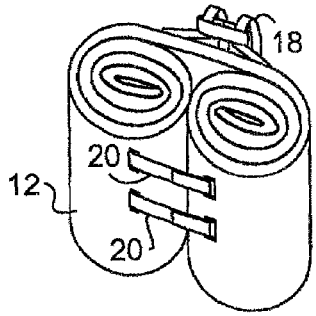
Figure 12D:
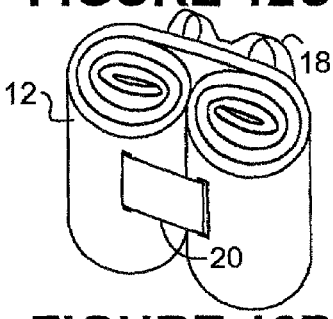
Figure 12H:
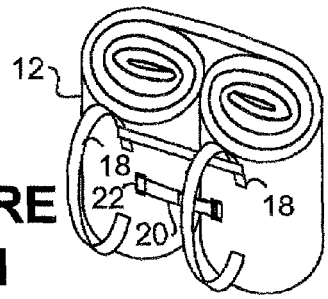

The final configuration of the assembly 10, when folded, rolled, secured, and in use as a backpack can be seen in FIGS. 11 and 12, the latter including optional securing piece 38 and attached strap 39. FIGS. 12A through 12H illustrate alternative ways of folding and rolling the carrier for carrying or use as a back pack.

Figure 13:
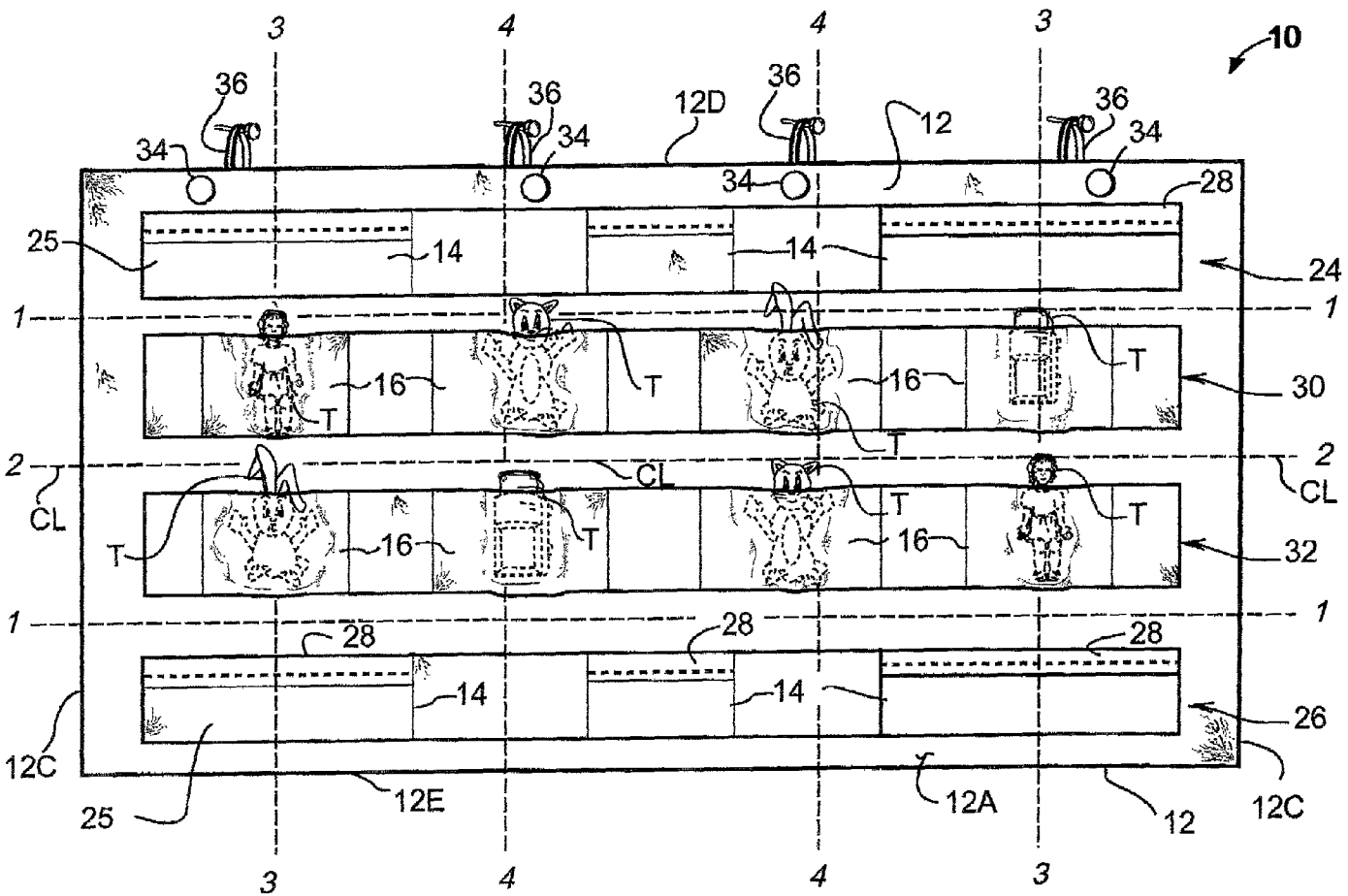
FIG. 13 is a plan view of a carrier of the present invention, showing a plurality of pockets in an alternate arrangement.
Figure 14:
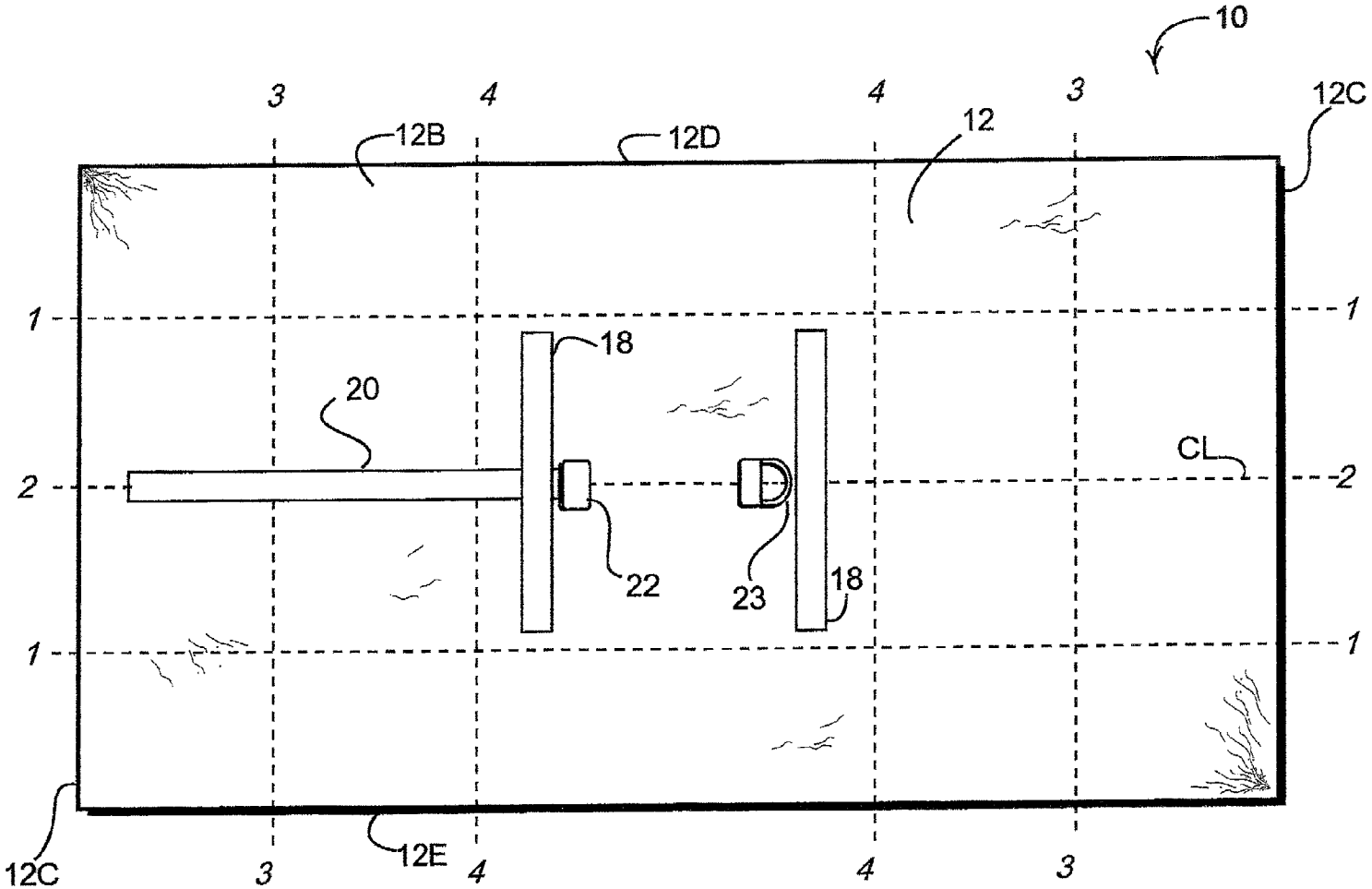
FIG. 14 is a plan view of the opposite side of the carrier of FIG. 13, showing securing and carrying means.

Referring further to the drawings, FIGS. 13 and 14 illustrate a flexible foldable multi-article storage carrier assembly, generally designated 10, of the present invention with the pockets and hanging means oriented differently. The flexible foldable multi-article storage carrier assembly 10 basically includes a blanket 12 having on front face 12A a plurality of spaced apart first compartments 14 along each longitudinal edge, a plurality of spaced apart second compartments 16 arranged in two lines down the center of blanket 12, a pair of spaced apart flexible straps 18, a flexible retention strap 20 attached at 22 and a fastener 23, all attached to the opposite side 12B of blanket 12 from the compartments. The term "blanket" will be used to refer to the flexible sheet component for this embodiment. Optionally, strap 20 can be loose rather than physically connected to blanket 12. A securing loop, buckle or the like 23 can be provided to help secure strap 20.

The blanket 12 preferably has a rectangular configuration and has opposite front and rear surfaces 12A, 12B, opposite side edges 12C and top and bottom edges 12D, 12E. (Top and bottom are determined by which side is to be uppermost when the blanket is hung up, as explained above.) The blanket 12 may also have any other suitable configuration.

Figure 15:
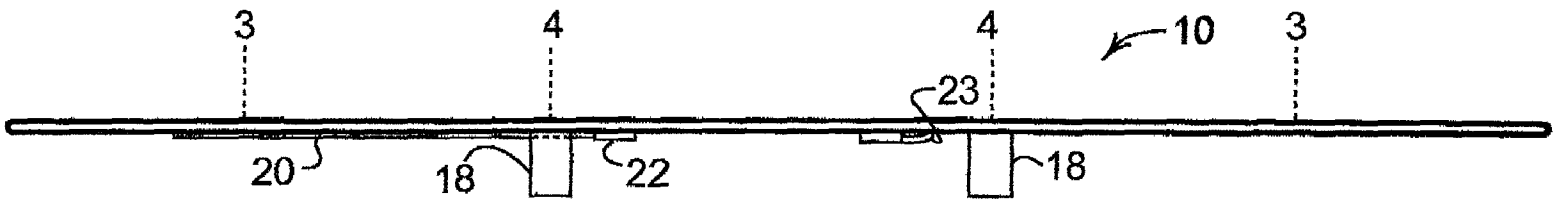
FIG. 15 is a side view of the carrier of FIG. 13, with the pocket side placed upward and partially folded.
Figure 15A:
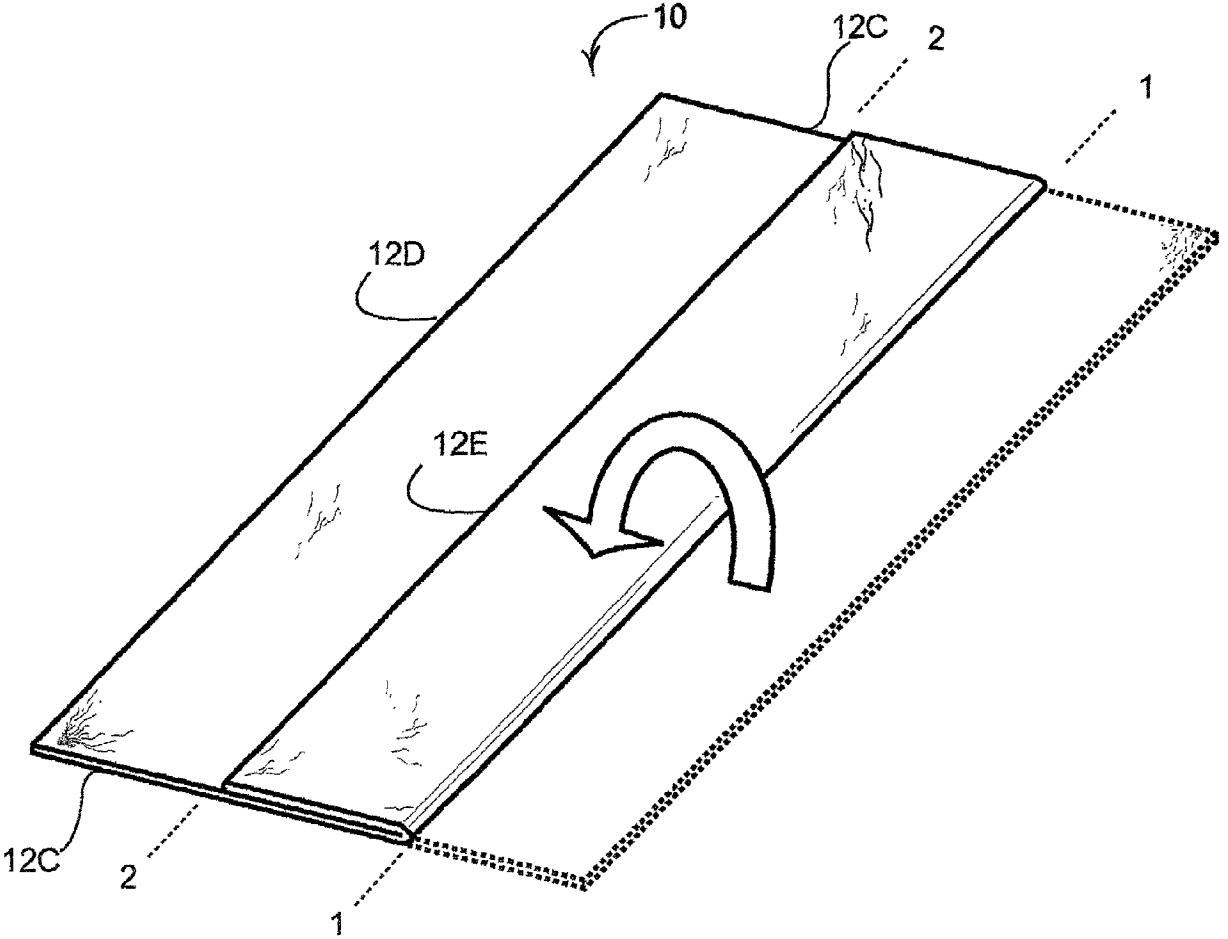
FIGS. 15A, 15B and 15C are perspective views illustrating the process of folding the carrier of FIG. 13 for storage or transport.
Figure 15B:
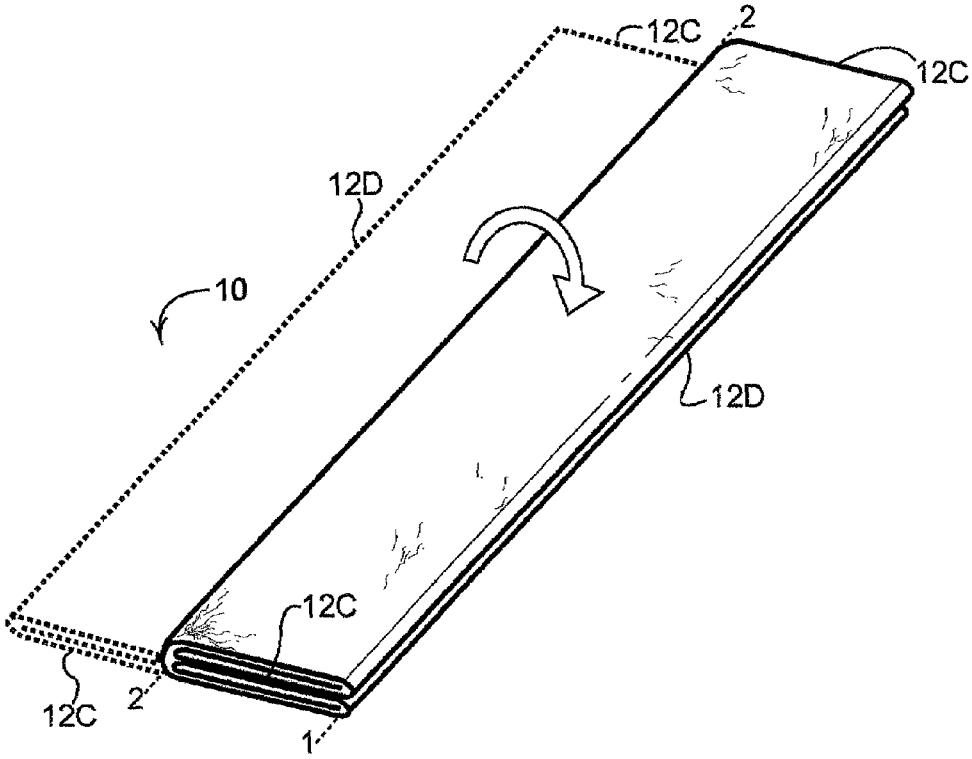
Figure 17:
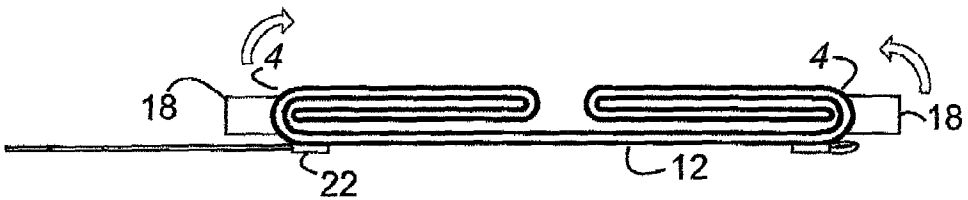
Figure 18:
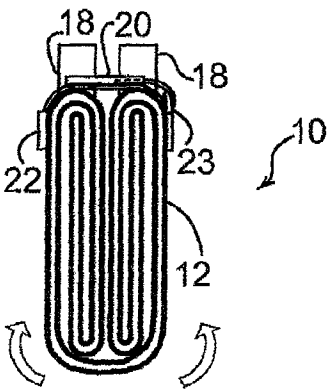
Figure 19:
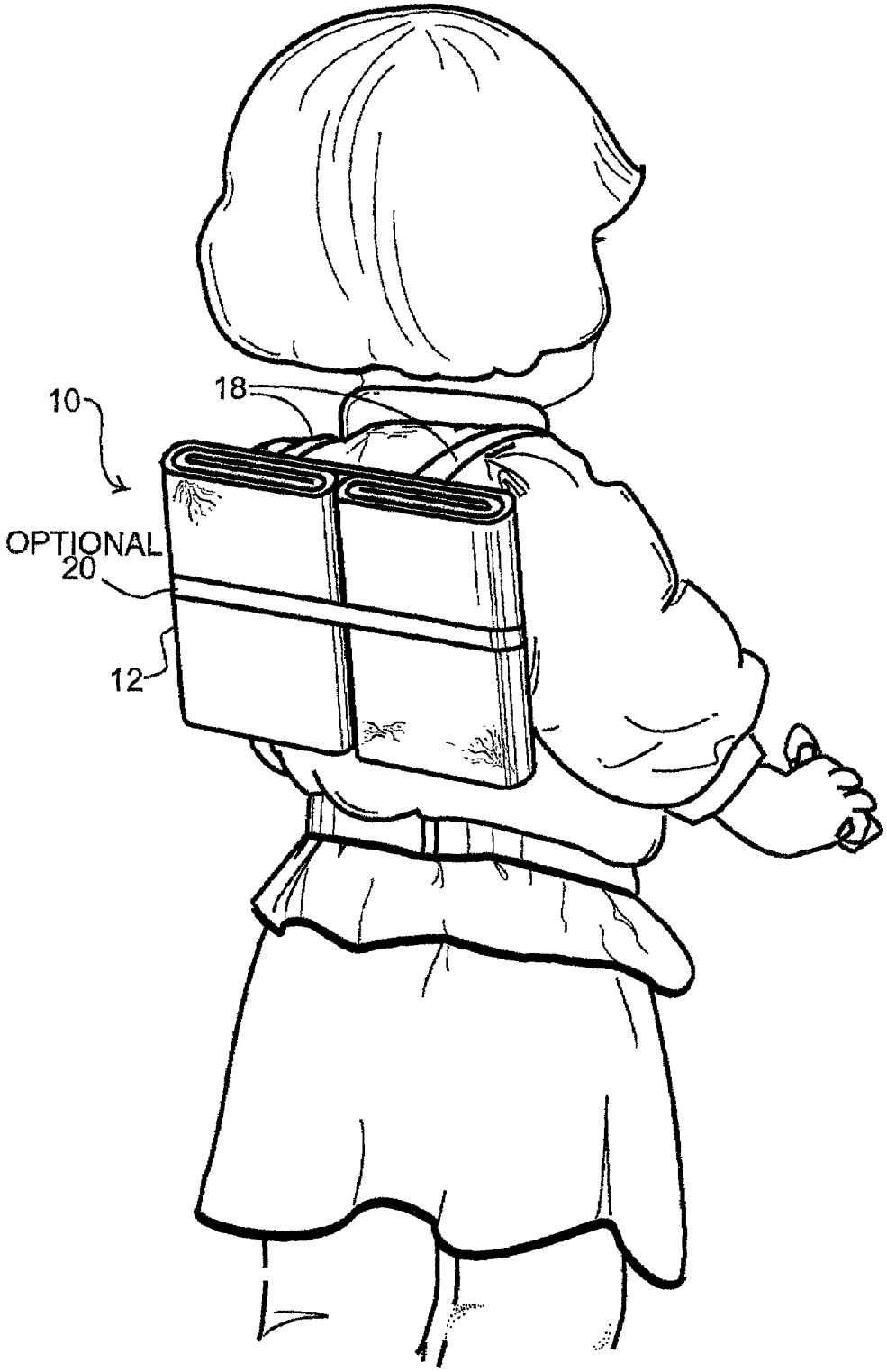
FIG. 19 is a perspective view of a user with the folded carrier in place as a backpack.

The blanket 12 is further convertible between an unfolded condition, as seen in FIGS. 13 and 14, and a folded condition for carrying or storage, as seen in FIGS. 18 and 19. In converting the blanket 12 to the folded condition, as illustrated in FIGS. 15 to 18 and 15A to 15C, blanket 12 is first folded widthwise by, first, being folded toward the longitudinal centerline CL of the blanket 12 along a pair of outer parallel fold lines (1) extending generally parallel to the top and bottom edges 12D, 12E of the blanket 12 and the longitudinal centerline CL of the blanket 12 and then folded inwardly again along a central fold line (2) extending parallel to the pair of outer fold lines (1) and the longitudinal centerline CL of the blanket 12. This position is seen in FIGS. 15A and 15. Centerline CL and central fold line (2) may coincide, as shown.

Figure 15C:
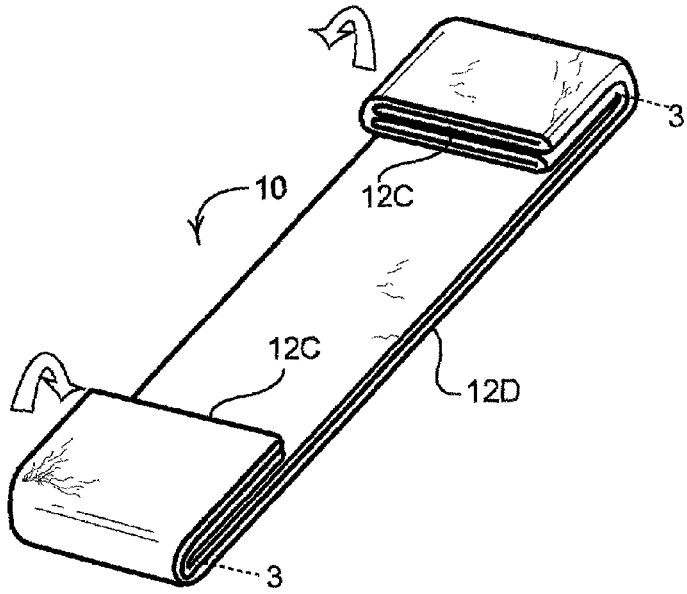
Figure 16:
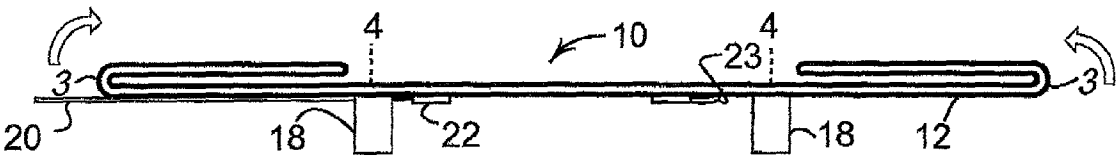
FIGS. 16, 17 and 18 are side views of the carrier of FIG. 13 illustrating the process of folding the carrier for storage or transport.

The widthwise folded blanket 12 represented in FIG. 15 is then folded lengthwise by, first, being folded inwardly, as seen in FIGS. 15C and 16, along a pair of outer side fold lines (3) extending generally parallel to the side edges 12C of the blanket 12, and then folded inwardly again, as seen in FIG. 17, along a pair of middle fold lines (4) extending generally parallel to the outer side fold lines (3). Finally, the blanket 12 is folded to the final folded condition, as seen in FIG. 18. This leaves flexible straps 18 exposed and parallel to the longitudinal dimension of the folded blanket. All compartments and their contents are then enclosed and secured. The blanket is then secured in folded condition with strap 20, by passing strap 20 through buckle 23 or by securing straps 18 to each other, as shown in FIG. 18.

The plurality of spaced apart first compartments 14, as seen in FIGS. 13 and 9, are attached on the front side 12A of the blanket 12 and form upper and lower rows 24, 26 which are disposed, respectively, adjacent to the top and bottom edges 12D, 12E and extend between the opposite side edges 12C of the blanket 12. As seen in FIGS. 13 and 9, additional strips of material 28 may be attached to blanket 12 along and overlapped with the top edges of the first compartments 14 so as to overlie and cover the open top edges, thus keeping the contents secure.

The plurality of spaced apart second compartments 16, as seen in FIGS. 13 and 10, are attached on the front side 12A of the blanket 12 and form upper and lower inner rows 30, 32 which are disposed adjacent to one another and, respectively, adjacent to the upper and lower outer rows 24, 26 and extend between the opposite side edges 12C of the blanket 12. Alternatively, a single row of larger compartments can be located in the center of the blanket (not shown). Like the first compartments 14, the second compartments 16 can be formed either by individual pieces of suitable material attached to the blanket 12 or, more preferably, by an elongated piece, 30 or 32 as shown in FIGS. 13 and 10, which is then attached or sewn to the blanket 12 so as to form the second compartments 16. As discussed above, the second compartments 16 are sewn closed along their bottoms and both opposite sides and left open at their top edges.

The pair of spaced apart flexible straps 18, as seen in FIGS. 14 to 18, are attached to the rear side 12B of blanket 12 and spaced inwardly from the opposite side edges 12C and top and bottom edges 12D, 12E of the blanket 12 so as to provide a pair of handles for gripping by a user to carry the blanket 12 when in the final folded condition. FIG. 19 illustrates the use of the compacted carrier of this embodiment as a back pack.

The flexible retention strap 20 and buckle 22, as seen in FIG. 14, are generally attached to the rear side 12B of the blanket 12 adjacent to the flexible straps 18 which, when the blanket 12 is in the final folded condition, are adjacent and can be attached together, as represented in FIG. 18, to retain the blanket 12 in the final folded condition. In the folded condition, the first and second compartments 14, 16 are inside the folded blanket 12 so that their contents are prevented from falling out. Loop 23 is exemplary of various fastener means (including fabric or plastic loops or rings, D-rings and the like) which can be used.

A plurality of spaced apart holes 34 can be defined in the blanket 12 along the upper (longitudinal) edge 12D thereof and/or a plurality of spaced apart hanger loops 36 can be attached to the upper edge 12D of the blanket 12; either can be used to hang the blanket 12 in the unfolded condition of FIG. 13 on a wall or like surface.

EXAMPLE

The usefullness of the carriers of the present invention will be illustrated by the following non-limiting example. A carrier similar to that shown in FIGS. 1 to 12 was fabricated of denim fabric, measuring about 35 by 55 inches overall. Sets of 6 pockets measuring about 10 by 12 inches were provided along each of the longer edges, with an additional set of 8 pockets measuring about 6 by 9 inches along the center of the carrier. All these pockets were located on the same side of the flexible sheet component of the carrier. A number of Barbie(R) dolls manufactured by Mattel Corp. were purchased on the retail market and tested in the carrier. It was found that this model comfortably accommodated a total of eight dolls in the compartments, and a total of at least six miscellaneous accessories in the other pockets. The carrier could be hung on a wall or other vertical surface to display the dolls and accessories in a convenient arrangment for use. When the carrier loaded with dolls and accessories was folded and rolled as described above and illustrated in FIGS. 3 to 7, the compacted unit could be secured in that position and the exposed straps used either for carrying handles or to secure the carrier on the user's back as a back pack.

Description of Example Use

The carrier is designed to be adaptable for a number of items including, but not limited to, fashion and action dolls, toy automobile collections, musical instrument accessories and other items to be securely held and carried. This example was designed for fashion dolls. The carrier in its open configuration, either flat on a horizontal surface or hung vertically, holds a number of fashion dolls and accessories in their respective pockets by either pocket closures or gravity.

When the owner is ready to go to a friend's house to play, she simply folds and rolls the carrier as described above, enclosing the dolls and acessories into a back pack form for easy and secure movement. To fold/roll the carrier into its designed carrying configuration, the carrier needs to be opened and extended on a horizontal surface. For proper folding, this version of the carrier should be positioned with its longest sides running from left to right as the owner looks at the extended carrier. The dolls or action figures and accessories should also be positioned facing upward, so as the first folds are made, the items are covered. The owner first folds the two ends toward the center of the carrier, covering the items. This halves the size of the overall carrier in its extended form. Then the owner folds this resulting square in half again in the same direction as the first two folds. Now the carrier is one quarter the size as when in its fully extended configuration. This last fold should result in the carrying and securing straps being positioned on the bottom of the carrier. If the straps are on top, however, the carrier should be flipped over so that the straps are on the bottom. This puts the carrier in the correct position for rolling into the final form for carrying.

Next, the owner rolls up the carrier from each end toward the middle. When the two sides meet, the securing straps will be revealed and should be secured to hold the carrier in its folded/rolled configuration. At this point, the carrier is in its final configuration, ready to be carried by hand or used as a back pack, in both cases using the shoulder straps.

The additional triangular securing flap used in this example may or may not be included in the carrier. This flap provides additional securing of the carrier and also serves as a location for commercial advertising by the manufacturer and/or owner identification. The example described above does include such a securing flap. After the carrier is rolled and securely strapped, this additional flap is folded up over the rolled carrier. It is secured in this position by passing the strap at the tip of the securing flap through the loop or closing the connector provided at the joining point of the shoulder straps. Depending upon the type of connector, the flap can be secured by either closing the connector or by folding the strap back upon itself and securing it via hook-and-loop material.

Various changes and modifications to the presently preferred embodiments will be apparent to those skilled in the art. Such changes and modifications may be made without departing from the spirit and scope of the present invention and without diminishing its attendant advantages. Therefore, the appended claims are intended to cover such changes and modifications, and are the sole limits on the scope of the invention.

What is claimed is:

1. A multi-article storage carrier comprising a sheet of flexible material of substantially rectangular shape, having on one surface a plurality of compartments for enclosing said articles and on the other surface securing and carrying means for the carrier when assembled, wherein said carrying means comprise at least two straps which are so located and configured as to serve as either handles or carrying straps when said carrier is folded, and are also adapted to help secure the folded carrier in place, said securing and carrying means being so arranged as to compactly secure the carrier and provide carrying means when the sheet of flexible material is folded at least once each through approximately 180 degrees in its longitudinal and transverse dimensions to enclose said compartments and articles in the interior of said carrier.

2. The carrier of claim 1 which comprises attachment means along at least one side suitable for hanging the carrier up in open position.

3. The carrier of claim 2 wherein said compartments are arranged with their open sides oriented to face upward when said carrier is hung up in open position.

4. The carrier of claim 1 wherein at least a portion of said compartments are fitted with closure means to enclose the articles securely.

5. The carrier of claim 4 wherein said closure means comprise flaps of flexible material.

6. The carrier of claim 4 wherein said closure means comprise at least one of zippers, hooks and eyes, hook and loop material or snap fasteners.

7. The carrier of claim 1 which comprises a plurality of compartments arranged along two opposing edges of said sheet which are sized and configured to contain accessories, and at least one set of compartments located in the central portion of said sheet which are sized and configured to contain fashion dolls or action figures.

8. The carrier of claim 7 wherein said central compartments are sized and configured to contain at least one fashion doll and said compartments arranged along said edges are sized and configured to contain accessories for said doll(s).

9. The carrier of claim 1 wherein said straps are adjustable in length and can be used for carrying said carrier from the shoulder or to secure said carrier upon the back as a backpack.

10. The carrier of claim 1 wherein said securing means comprise at least one strap which can be used to secure said carrier in folded position, either by passing said strap completely about said carrier and connecting the ends of said strap, or by securing said carrying straps together.

11. The carrier of claim 10 wherein said securing means comprise at least one securing piece attached to said sheet adjacent said carrying straps and a securing strap attached thereto which can be passed about the carrier in folded condition with said securing strap substantially parallel to said carrying straps.

12. The carrier of claim 1 wherein said sheet can be folded at least twice in each direction to enclose said articles and configure said carrier for storage or transport.

13. The carrier of claim 1 wherein said said flexible sheet comprises at least one layer of a fabric.

14. The carrier of claim 13 wherein said fabric is selected from the group consisting of woven and nonwoven fabrics of natural and synthetic fibers.

15. The carrier of claim 13 wherein at least one layer of said fabric contains cushioning material.

16. The carrier of claim 13 wherein said sheet of flexible material is suitable for use as a blanket or mat when said articles are removed.

17. The carrier of claim 13 wherein said sheet of flexible material comprises at least one layer of a water-resistant material.

18. A multi-article storage carrier comprising a flexible sheet of material of substantially rectangular shape, having on one surface a plurality of compartments formed and arranged to contain various articles of certain sizes and shapes, with a series of said compartments arranged along opposing sides of said sheet and at least one series of compartments arranged in the central portion of said sheet on the same surface, between said compartments along said edges, said compartments each having at least one opening to receive said articles, with all said openings being oriented in the same direction;

said compartments being so arranged upon said sheet as to be completely enclosed within said carrier when said sheet is folded at least once in each direction; and on the other surface of said sheet, at least two carrying straps arranged parallel to two sides of said sheet so that they are exposed when said carrier is folded to enclose said articles, with at least one additional strap provided which can be arranged perpendicular to said carrying straps to encircle the folded carrier to secure it in the folded position.

19. A multi-article storage container comprising a flexible sheet of material of substantially rectangular shape, having on one surface a plurality of compartments formed and arranged to contain various articles of certain sizes and shapes, with a series of said compartments arranged along opposing sides of said sheet and at least one series of compartments arranged in the central portion of said sheet on the same surface, between said compartments along said edges, said compartments each having one opening to receive said articles, with all openings being oriented in the same direction and comprising closure means;

said sheet further comprising attachment means arranged along an upper edge of said sheet towards which the compartment openings are directed so that said carrier can be hung vertically for storage and display;

said compartments being so arranged upon said sheet as to be completely enclosed within said carrier when said sheet is folded or rolled at least once in each direction; and on the other surface of said sheet, at least two carrying straps arranged parallel to two sides of said sheet so that they are exposed when said carrier is folded and rolled to enclose said articles, with at least one additional strap provided which can be arranged perpendicular and/or parallel to said carrying straps to encircle the folded and rolled carrier to secure it in the folded position.

* * * * *